US006662398B1

(12) United States Patent
Thomson

(10) Patent No.: US 6,662,398 B1
(45) Date of Patent: Dec. 16, 2003

(54) HANDS FREE FOOT SCRUBBER

(76) Inventor: Jeffrey A. Thomson, 293 Prospect St., Nutley, NJ (US) 07110

( * ) Notice: Subject to any disclaimer, the term of this patent is extended or adjusted under 35 U.S.C. 154(b) by 131 days.

(21) Appl. No.: 10/071,295

(22) Filed: Feb. 11, 2002

Related U.S. Application Data

(60) Provisional application No. 60/303,282, filed on Jul. 3, 2001.

(51) Int. Cl.[7] ..... A47K 7/04

(52) U.S. Cl. ..... 15/104.92; 4/606; 601/136

(58) Field of Search ..... 15/104.92; 4/606; 601/136, 154

(56) References Cited

U.S. PATENT DOCUMENTS 3,548,439 A * 12/1970 Berst ..... 15/104.92
3,973,286 A * 8/1976 Logan ..... 15/104.92 X
5,163,200 A * 11/1992 Carlin et al. ..... 15/104.92
5,177,829 A * 1/1993 Simpson ..... 15/104.92
5,983,433 A * 11/1999 Chapman ..... 15/104.92
6,223,379 B1 * 5/2001 Martin ..... 15/104.92
6,389,631 B1 * 5/2002 Keith ..... 15/104.92

* cited by examiner

*Primary Examiner*—Mark Spisich
(74) *Attorney, Agent, or Firm*—Edward Goldberg

(57) ABSTRACT

A bath mat includes a raised foot pad area having bristles on an upper surface and an enclosed refillable bladder containing liquid soap fitting within the under surface below the foot pad. Foot pressure causes soap to be released through tubular passages in the bladder engaging corresponding passages in the foot pad. Feet may be cleaned by scrubbing on the bristles without having to bend over or use the hands. The mat includes water drain holes and suction cups on the bottom of the mat and bladder which hold the components in place.

16 Claims, 4 Drawing Sheets

FIG. 8
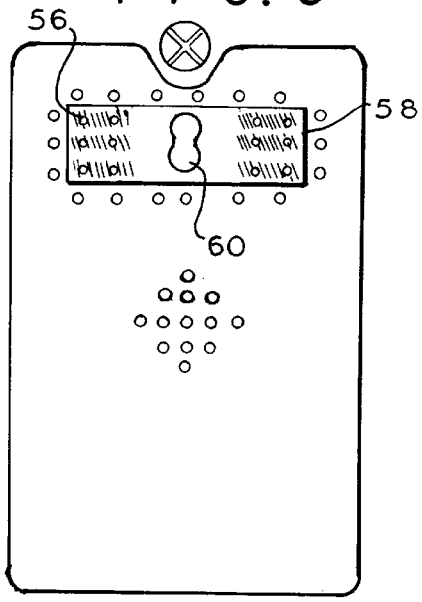
FIG. 9
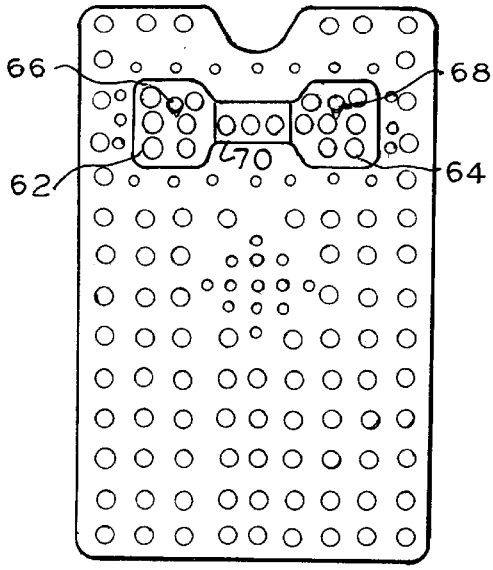
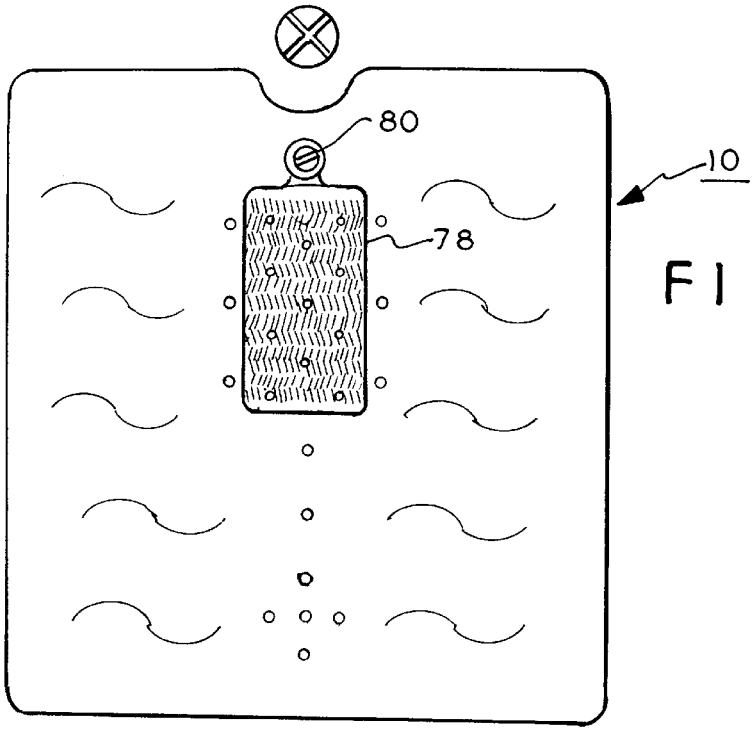
FIG. 11
FIG. 12
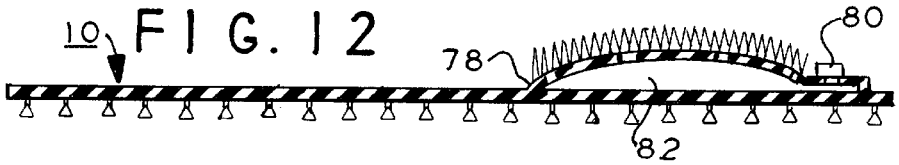

FIG. 13
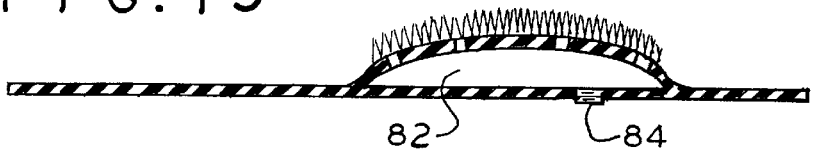
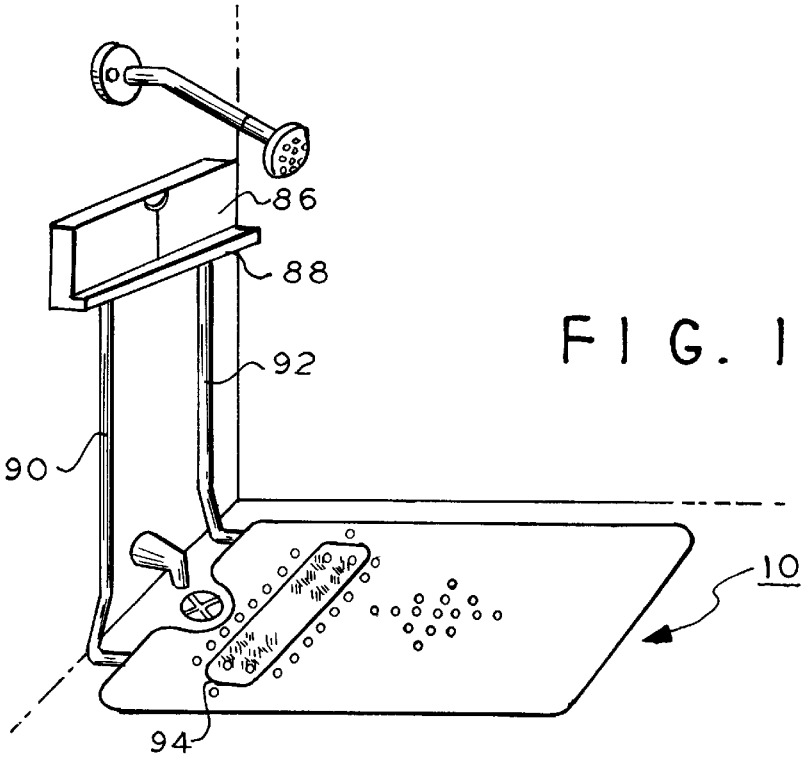
FIG. 14
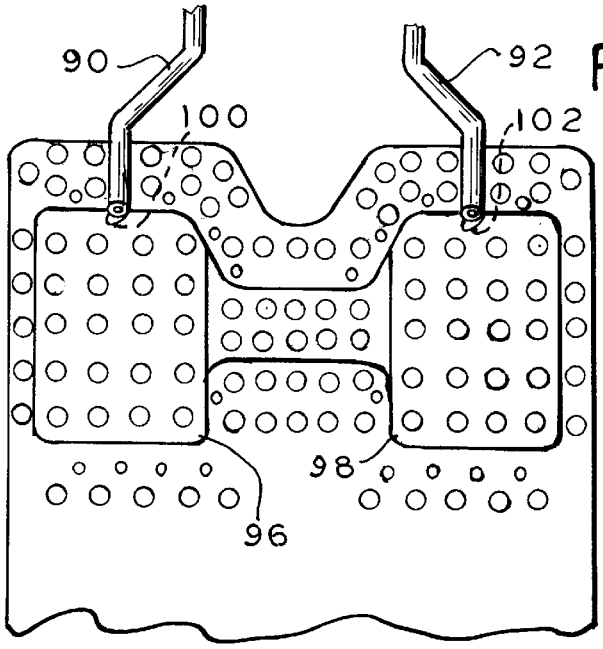
FIG. 15

HANDS FREE FOOT SCRUBBER

CROSS REFERENCE TO RELATED APPLICATIONS:

This application claims the benefit of U.S. Provisional Application No. 60/303,282 filed Jul. 3, 2001.

BACKGROUND OF THE INVENTION

1. Field of the Invention

The present invention relates to a bath or shower mat which allows a user to wash and scrub the feet easily without having to bend over or lift the legs and without requiring use of the hands. The mat includes soft flexible bristles on an upper surface and a refillable enclosure containing liquid soap within the lower surface. Foot pressure releases the soap through tubular passages into openings in the upper surface. Movement of the feet over the bristles cleanses the feet in a safe simple manner.

2. Description of the Prior Art

Previous foot scrubbing devices for washing a users feet within a shower employing bristles on a base member are known, such as shown in the following patents.

U.S. Pat. No. 5,729,858 to Riffel utilizes a base having a plurality of suction cups on a lower surface for holding the base on a shower floor. A plurality of bristles extend upwardly from a forward section of the base and inwardly from a pair of side walls. Additional toe bristles are disposed in the forward section.

U.S. Pat. No. 5,813,078 to Hogan, Sr. employs a shower foot washer including a base platform with suction cups on a lower surface and a plurality of bores between the bottom and top surfaces of the platform allowing water and soap to drain into the shower stall. A casement at one end extends upwardly from the platform and includes vertical partitions with protruding brush extensions for receiving toes. A button on top of the casement is pressed to dispense soap into the brush area. The bottom of the foot is cleansed by sliding along the platform.

U.S. Pat. No. 6,253,407 to Bjelkevig shows a foot scrubber including a base positioned on a shower floor with bristles on a upper resilient surface which can be contoured. The length of the bristles are staggered to fit the shape of the foot. A toe scrubber can be inserted into a cavity in the base. Additional bristles can be added to side walls extending from the base. The resilient section is also detachable from the base to permit separate washing of the sections.

While these prior art devices show foot scrubbers with bristles of various types, none of these employ a refillable liquid soap enclosure within the lower portion of a mat with tubular passages releasing soap through openings on the upper surface for cleansing of the feet.

SUMMARY OF THE INVENTION

It is therefore a primary object of the invention to provide a novel device for washing and scrubbing feet in a shower or bath tub without having to bend over or use the hands.

It is another object of the present invention to provide a foot scrubber mat which is safe and easy to use in a hands free manner.

It is a further object of the invention to provide a bath mat with bristles on an upper surface for scrubbing the feet.

Another object of the invention is to provide an easily refillable container of liquid soap within the lower surface of a bath mat which is released through passages to the upper surface having bristles.

A still further object of the invention is to provide a foot scrubbing mat with bristles on the upper surface and a container of liquid soap in the lower surface, with foot pressure releasing soap through tubular passages connected to openings on the upper surface.

These objects are achieved with a unique structure of a mat having suction cups holding the mat safely on a bath tub or shower floor. The upper surface includes soft flexible bristles in designated areas for receiving the feet of the user. The lower surface includes a liquid soap filled container or bladder with tubular passages connected to openings in the upper surface. Foot pressure releases soap to the upper surface and bristle areas for scrubbing of the feet without bending over and without use of the hands. The bladder includes a capped tubular opening for refilling with liquid soap. Other objects and advantages will become apparent from the following description in conjunction with the accompanying drawings.

DESCRIPTION OF THE DRAWINGS

FIG. 8 is a top plan view of a bath mat having two connected foot washing areas on the upper surface.

FIG. 9 is a bottom view of the bath mat having two connected soap bladders on the lower surface.

FIG. 11 is a top view of a larger bath mat having one central foot washing area and a refill outlet on the upper surface.

FIG. 12 is a side cross sectional view of a soap bladder enclosed within the mat below the foot washing area and having the refill outlet on the upper surface.

FIG. 13 is a side sectional view of a soap bladder enclosed within a mat below the foot washing area and having a refill outlet secured in the bottom surface.

FIG. 14 is a perspective view of a bath mat having a wall mounted soap dispensing unit connected to a soap bladder under the mat.

FIG. 15 is an enlarged underside view of the end of the mat and soap bladder connected to the wall mounted unit.

DESCRIPTION OF THE PREFERRED EMBODIMENTS

Figure 1:
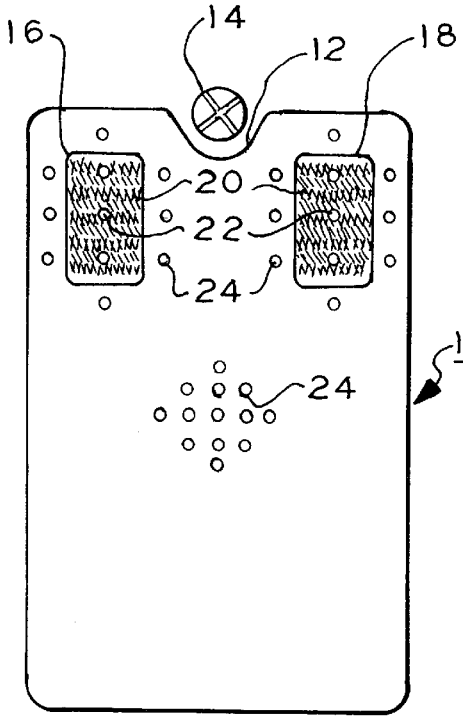
FIG. 1 is a top plan view of a bath mat showing two separate foot washing areas and drain holes on the upper surface.

As shown in FIG. 1, the present novel bath mat 10 of a suitable non-porous flexible plastic material such as vinyl is placed lengthwise on the floor at the head of the bath tub with a cutout portion 12 being positioned around the outlet drain 14. The upper surface includes two spaced raised foot pads 16, 18 at the forward end of the mat. Each pad includes a plurality of upwardly extending soft bristles 20, preferably formed of a suitable durable resilient plastic material such as vinyl, and outlet openings 22 for liquid soap. Water drain holes 24 are disposed around the pad areas and in a central area of the mat.

Figure 2:
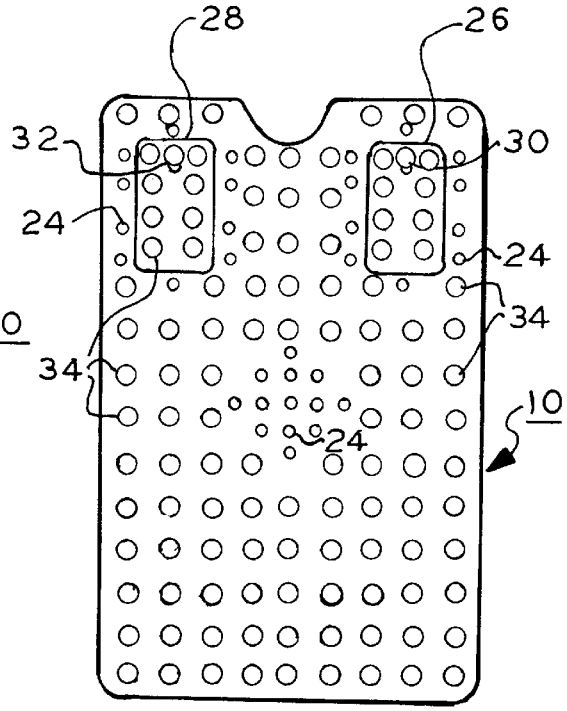
FIG. 2 is a bottom view of the bath mat showing two soap bladders and suction cups below the lower surface.

FIG. 2 shows the underside of the mat with the foot pad areas having separable soap containers or bladders 26, 28 of pliable tear resistant polyurethane or propylene filled with liquid soap fitting within the space below the pads. The bladders include capped refill holes 30, 32. The bottom surface of the entire mat and bladders include a plurality of suction cups 34 to hold the mat and bladders in place on the tub floor to prevent slippage.

Figure 3:
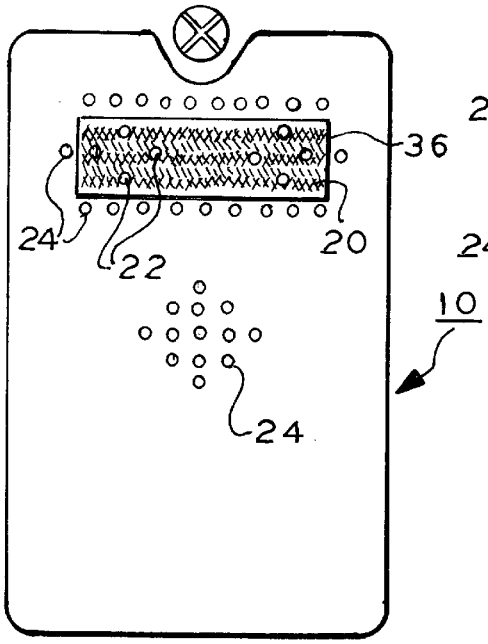
FIG. 3 is a top view of a bath mat having one foot washing area on the upper surface.
Figure 4:
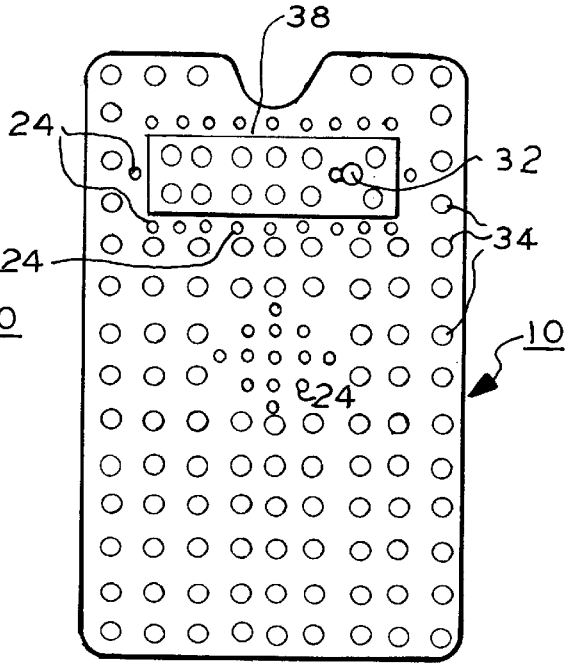
FIG. 4 shows the underside of the bath mat with a single soap bladder.

FIGS. 3 and 4 show a like bath mat with one foot pad 36 extending partially across the width of the upper mat in place of the two pads of FIGS. 1 and 2. The pad includes the same bristles 20 and soap outlet openings 22 with the mat including the same drain holes 24. The underside includes a single soap bladder 38 fitting within the upper foot pad and a like capped refill hole 32, as well as suction cups 34 below the mat and bladder.

Figure 5:
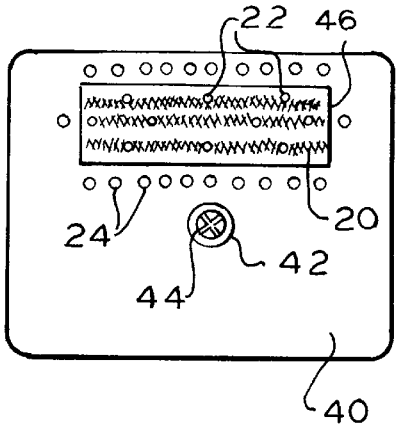
FIG. 5 is a top view of a shower mat having one foot washing area on the upper surface and a central opening for the shower drain.

FIG. 5 shows a smaller mat 40 for use in a shower stall rather than a bath tub. A central opening 42 is positioned over the shower drain pipe 44. The foot pad 46 is the same as that of FIGS. 3 and 4 with the same type of bristles 20 and soap outlet openings 22. The mat likewise includes water drain holes 24. The soap bladder and underside are also the same as those of FIGS. 3 and 4.

Figure 6:
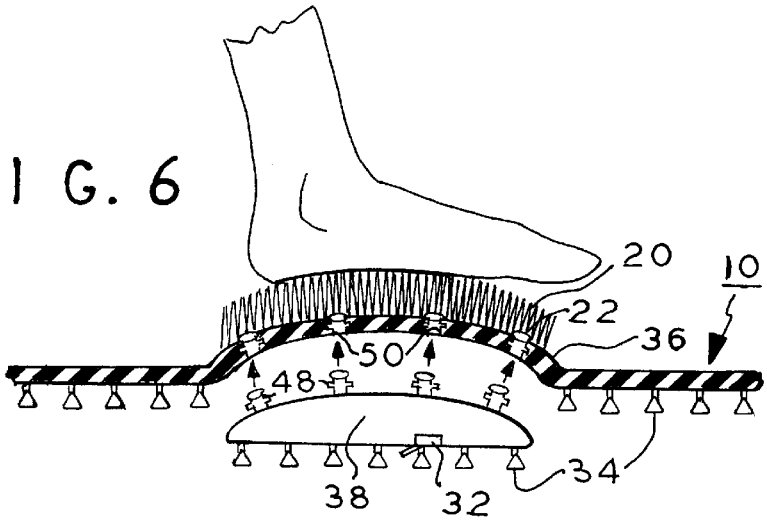
FIG. 6 is a partial side cross sectional view of the foot washing area on the upper mat and a soap bladder which fits into the lower surface of the mat.

FIG. 6 is an enlarged cross section of the upper foot pad 36 and separable lower soap bladder 38 of the mat showing the foot of a person over the bristle portion. The bladder includes a plurality of ridged tubular connectors 48 on the upper surface having openings which fit closely and engage similarly shaped slightly larger outlets 50 in the foot pad to release liquid soap through openings 22. This occurs when subject to foot pressure of the individual scrubbing feet on the bristles of the upper pad surface.

Figure 7A:
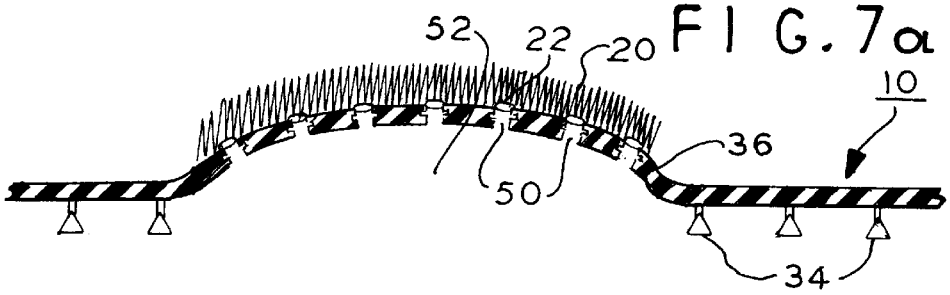
FIGS. 7*a* and 7*b* are enlarged side sectional views of the upper foot washing area and lower soap bladder.
Figure 7B:
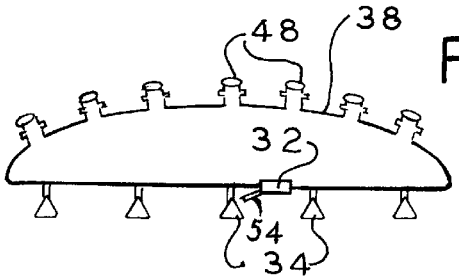

FIG. 7*a* shows a further enlarged mat cross section of the raised foot pad 36 with bristles 20 and soap openings 22 on the upper surface and suction cups 34 on the lower mat surface. The open area 52 below pad 36 is adapted to receive soap bladder 38 shown enlarged in FIG. 7*b*. The ridged tubular connectors 48 with openings on the bladder upper surface fit tightly within the like shaped larger outlets 50 in the foot pad. The bladder openings are slightly smaller than the openings 22 on the foot pad to prevent return of the liquid soap emitted from the bladder. Soap refill hole 32 includes a cap and pull tab 54 to adding liquid soap when required and preventing leakage. The bladder may contain about 30 ounces of soap. The bladder and mat may be rinsed and cleaned separately.

FIGS. 8 and 9 show a bath mat having a foot scrubbing area extending across the width of the upper mat which has two sections of bristles 56, 58 separated by a central foot rest area 60. The underside of the mat includes two spaced soap bladders 62, 64 with refill holes 66, 68. A central web 70 connects the bladders in a common unit to fit within the upper foot pad area while requiring less soap than one larger bladder.

Figure 10:
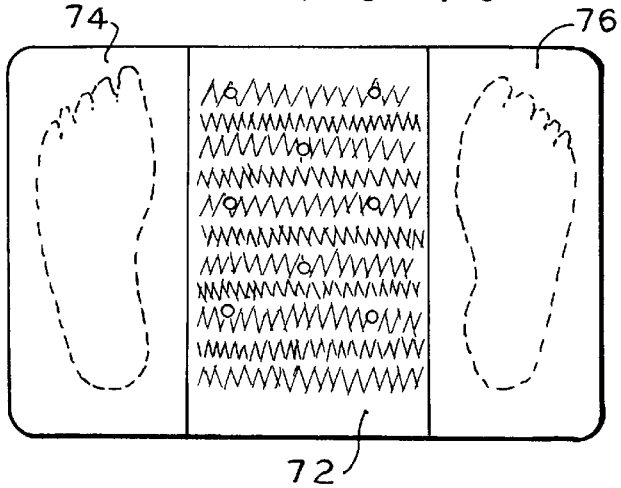
FIG. 10 is a top view of a small bath mat having a central foot washing area and two foot resting areas alongside.

FIG. 10 shows a top view of a smaller mat having a central foot pad scrubbing area 72 including bristles and soap openings with opposite sides providing separate foot rest areas 74, 76. The underside will receive only one central soap bladder engaging the upper pad.

FIG. 11 shows a bath mat 10 having one elongated central foot pad 78 with bristles and soap outlet holes on the upper surface and water drain holes in the mat. In this case the soap refill hole and a plug 80 are on the upper surface. FIG. 12 shows a side partial cross sectional view of this foot pad and mat. The soap bladder 82 is now integral with and enclosed within the bottom of the foot pad and within the bottom of the extended mat to hold the entire unit in a more secure safe manner with suction cups along the full length of the mat. The location of the refill hole and cap on the upper surface of the foot pad also maintains the integrity of the lower surface and provides easier access for refilling.

FIG. 13 shows an alternate cross section of the enclosed integral soap bladder with a threaded refill hole and plug 84 that can be screwed into the bottom of the mat and bladder while providing a tight seal. When not in use, the foot pad area of the mat and empty soap bladder can be flattened and stored for later use.

FIG. 14 is a perspective view of a wall mounted refillable soap dispenser 86 and hand pump 88 which connects two tubes 90, 92 to two spaced soap bladders below mat 10. Foot pad 94 includes two areas of bristles and soap outlets at opposite ends of the upper pad and drain holes around the pad and in the center of the mat. FIG. 15 is an enlarged view of the underside of the end of the mat showing the tubes connecting to the spaced bladders 96, 98. The tube ends include stop valves 100, 102 to prevent soap from backing up into the tubes. The lower surfaces of the mat and bladders include suction cups holding the components in place. This configuration permits persons with health problems or having difficulty in bending to fill the soap dispenser on the wall instead of directly into the container under the foot pad.

While several embodiments have been illustrated and described, other variations may be made in the particular configuration without departing from the scope of the invention as set forth in the appended claims.

What is claimed is:

1. A foot scrubber comprising:

a base member having upper and lower surfaces, a raised foot pad area disposed on the upper surface of said base member, a plurality of resilient bristles extending upwardly from said foot pad area, a liquid soap container having an upper surface positioned against said base member lower surface below said foot pad area, soap release openings in said soap container upper surface, and soap receiving outlets between said upper and lower base member surfaces in said foot pad area aligned with said soap release openings, whereby foot pressure on said pad area releases soap from said container onto said pad area and bristles for scrubbing the foot of a user.

2. The foot scrubber of claim 1 wherein said base member is a bath mat, said foot pad area extends across a portion of the width of said mat, said mat having foot rest areas adjacent said pad area, said foot rest areas including a plurality of water drain holes for removing water and soap from said mat.

3. The foot scrubber of claim 2 wherein said liquid soap container includes a capped filling opening.

4. The foot scrubber of claim 2 wherein areas spaced from said foot pad on the lower surface of said bath mat and areas on the lower surface of said soap container include a plurality of suction cups for securing said mat and container on a support surface.

5. The foot scrubber of claim 4 wherein said foot pad area is divided into two separate areas spaced apart across the width of said mat and includes two spaced soap containers below respective foot pad areas, each said soap container including a capped filling opening and lower surface suction cups.

6. The foot scrubber of claim 5 including a web connecting said spaced soap containers together as a common unit.

7. The foot scrubber of claim 4 wherein said soap container soap release openings include tubular extensions and said soap receiving outlets in said foot pad area includes tubular passages, said tubular extensions tightly engaging and being slightly smaller than said tubular passages to prevent return of liquid soap into said container.

8. The foot scrubber of claim 4 wherein said bath mat includes an inward curvature at one end for placement adjacent to a bath tub drain.

9. The foot scrubber of claim 4 wherein said bath mat includes a central opening for placement over a shower drain.

10. The foot scrubber of claim 4 including a wall mounted manually operable liquid soap dispenser, and tubing connecting said dispenser to said soap container below said foot pad area of said mat.

11. The foot scrubber of claim 10 including a stop valve connecting said tubing to said soap container for preventing return of soap.

12. The foot scrubber of claim 11 wherein said foot pad area is divided into two separate areas spaced apart across the width of said mat and includes two separate soap containers below respective foot pad areas, said tubing including a pair of tubes connecting said dispenser to respective soap containers.

13. The foot scrubber of claim 4 wherein said bath mat, foot pad, bristles, soap container and suction cups are formed of water impervious resilient plastic materials.

14. The foot scrubber of claim 2 wherein said soap container is enclosed in said bath mat below said foot pad area, the lower surface of said bath mat extending across the areas below said soap container and including lower surface suction cups.

15. The foot scrubber of claim 14 wherein said enclosed soap container includes a capped filling opening in an upper surface of said mat.

16. The foot scrubber of claim 14 wherein said enclosed soap container includes a filling opening in the lower surface of said mat and a threaded plug sealing said filling opening.

* * * * *